United States Patent [19]

Lundgren

[11] 4,242,859

[45] Jan. 6, 1981

[54] THREAD SPINNING APPARATUS

[75] Inventor: William E. Lundgren, Northborough, Mass.

[73] Assignee: Lawrence M. Keeler, Whitinsville, Mass.

[21] Appl. No.: 113,972

[22] Filed: Jan. 21, 1980

[51] Int. Cl.[3] ..... D01H 7/882; D01H 1/12

[52] U.S. Cl. ..... 57/58.89

[58] Field of Search ..... 57/58.89, 58.91, 58.95

[56] References Cited

U.S. PATENT DOCUMENTS

| | | | |
|---|---|---|---|
| 3,945,185 | 3/1976 | Nakamura et al. | 57/58.95 |
| 3,994,120 | 11/1976 | Radom et al. | 57/58.89 |
| 4,077,197 | 3/1978 | Bowden et al. | 57/58.89 X |
| 4,174,604 | 11/1979 | Pallay | 57/58.89 |

*Primary Examiner*—Donald Watkins

*Attorney, Agent, or Firm*—Robert T. Gammons

[57] ABSTRACT

Apparatus for spinning comprising a spinning unit structured to receive a running length of roving into a vortex of air, impart twist thereto and discharge it in the form of a spun thread.

22 Claims, 5 Drawing Figures

THREAD SPINNING APPARATUS

BACKGROUND OF THE INVENTION

This invention relates to spinning and, in particular, to open-end spinning, with the aid of apparatus designed to be an improvement over such apparatus as shown in U.S. Pat. Nos. 3,978,648; 3,992,865; 4,107,911; and 4,142,354 in economy, power consumption, cleanliness in operation, minimal acoustal disturbance, versatility in thread composition and rate of thread production achieved by a unique combination of pneumatic and mechanical means.

SUMMARY OF THE INVENTION

As herein illustrated, the apparatus comprises a spinning unit to which a roving of fibers is introduced into a stream of air for dispersement and collection in the form of an embryonic thread and movement thereof between rotating friction-engendering surfaces for condensing and twisting the fibers to form a spun thread without false twist, the spinning unit comprising means defining an elongate passage of uniform diameter, a trumpet at one end of the passage through which the roving enters the unit, said trumpet containing an elongate passage of smaller diameter than that of the unit concentric therewith, means for delivering air jets to the interior of the elongate passage rearwardly of the inner end of the trumpet and peripherally thereof to form a vortex therein such as to collect fibers loosed from the roving in the form of an embryonic thread and means at the other end of the passage rotatable about the longitudinal axis of the passage in the direction of rotation of the vortex for imparting a true twist to the embryonic thread as it leaves the passage. The vortex is produced by a plurality of ports positioned in the wall of the passage rearwardly of the inner end of the trumpet, peripherally thereof and in tangential relation to the inner surface of the passage through which air under pressure is supplied to the passage. There is a manifold surrounding the passage for supplying air under pressure to the ports. The means at the other end of the passage for imparting twist to the embryonic thread is an annular raceway concentric with the axis of the passage and friction-engendering means arranged in the race to be rotated about the axis of the tubular passage by impingement of the air entering the passage through said ports. The aforesaid means comprise rolls which, when rotating within the raceway, define surfaces tangent to diametrically opposite sides of the thread rotating about the axis of the thread in the direction of rotation of the vortex which function to twist the fibers as they leave. The rolls are of a diameter such that their surfaces are substantially tangent to the center line of the passage and are free to turn about their own centers while rotating bodily about the tangential axis of the passage. There are exhaust ports rearwardly of the annular race and means for covering the ports rotatable relative to the tubular member for partially or wholly uncovering the ports.

The invention will now be described in greater detail with reference to the accompanying drawings, wherein.

Figure 1:
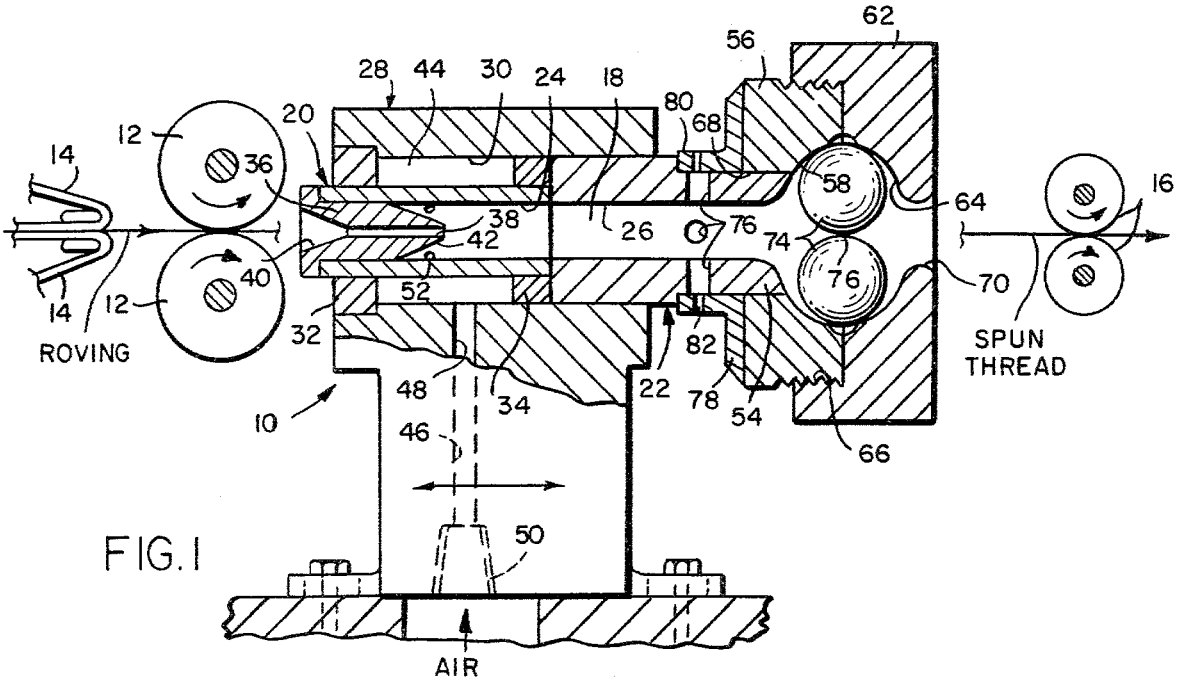
FIG. 1 is a view at right angles to the path of travel of the yarn being spun showing the spinning unit for the most part in vertical section.
Figure 2:
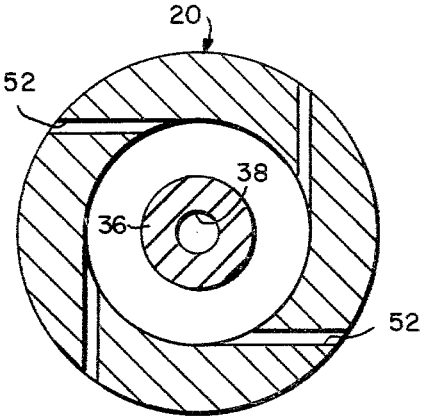
FIG. 2 is a section to larger scale taken transversely of the spinning unit on the line 2—2 of FIG. 1.
Figure 3:
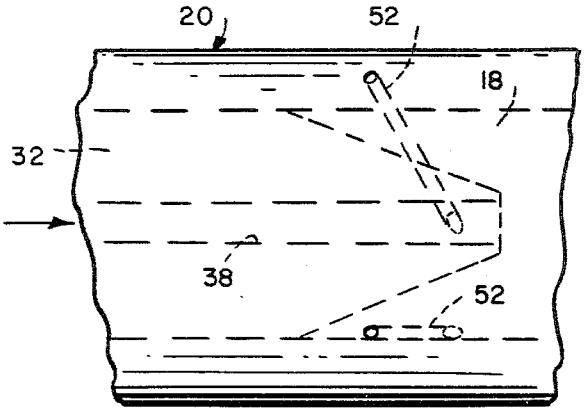
FIG. 3 is a plan view of FIG. 2.

Referring to the drawings, the spinning unit indicated generally at 10 is positioned between a pair of front rolls 12—12 which deliver roving or its equivalent from a pair of aprons 14—14 to the spinning unit and a pair of take-off rolls 16—16, the latter delivering the spun thread from the spinning unit to winding apparatus not shown herein for winding onto a suitable package or tube.

The aprons 14—14 draw the fibers of the roving to the desired attentuation and parallelism and deliver them to the front rolls 12—12 which, in turn, supply the attenuated roving of parallel fibers to the spinning unit.

The spinning unit according to the invention is designed to produce a spun thread without false twist by open-end spinning and as herein illustrated comprises means defining an elongate passage 18 of uniform diameter formed within a tubular structure made up of two parts 20 and 22 containing openings 24 and 26 held with their openings in axial alignment within a head block 28 containing a bore 30.

The part 20 is mounted within the bore 30 within axially-spaced centering rings 32,34 fixed within the bore. At the entrance to the passage 18, there is mounted within the opening 24 a trumpet 36 which defines an elongate passage 38 coaxial with the passage 18. The entrance to the passage 38 is tapered at 40 to facilitate threading the roving. The inner end of the trumpet is tapered at 42. The part 20 is of smaller outside diameter than the bore 30 in the head block so that there is defined within the inner side of the bore 30, the outer side of the part 20, and the centering rings 32 and 34 a manifold passage 44. A passage 46 in the head block 28 is connected at one end 48 with the manifold and at the other end is provided with a threaded opening 50 for receiving a corresponding threaded end of a conductor of air or other fluid under pressure. The wall of the part 20 surrounding the tapered end of the trumpet is provided with circumferentially-spaced ports 52 which are located rearwardly of the inner end of the tapered end 42, positioned tangentially with respect to the inner surface of the passage 18 and inclined forwardly toward the opposite end of the passage 18.

The part 22 is fitted into the bore 30 against the centering ring 34, projects forwardly from the head block and is provided with a portion 54 of reduced diameter on which there is mounted a block 56 containing a forwardly-facing annular recess 58 of larger diameter than the diameter of the passage 18 and concentric therewith. Block 56 is provided with exterior threads and a cap 62 provided with an annular recess 64 of corresponding configuration to the recess 58 is mounted to the block 56 by means of an internally-threaded flange 66. The block 56 contains a center opening 68 for receiving the reduced end of the part 22 and the cap contains a center opening 70, the recesses 58 and 64 of the block and cap in combination defining an annular raceway and within the raceway there are mounted two roller members 74—74 of a diameter such that, when disposed diametrically opposite each other within the annular raceway, their proximal surfaces 76—76 define a narrow thread path. The roller members may be spherical or cylindrical and, as herein shown, are spherical balls. The surfaces of the recesses are substantially toroidal in configuration so that the roller members 74—74 are free to roll around within the raceway chamber about an axis coinciding with the longitudinal axis of the passage 18 and to turn about their own centers. While two roller members are shown, a single roller member may be employed.

The part 22 rearwardly of the block 56 contains peripherally-spaced ports 76 which in FIG. 1 are shown to be radially positioned. A ring 78 is mounted on the part 22 for rotation thereon and is provided with a short sleeve portion 80 containing peripherally-spaced ports 82 similarly radially positioned. By rotation of the ring 78, the ports 82 may be aligned or disaligned with the port 76, thus to vary the air flow in the passage 18.

In operation, roving or sliver attentuated to the desired amount is delivered to the front rolls 12—12 and from thence by the front rolls 12—12 into the passage 38 of the trumpet 36. Air under suitable pressure is delivered to the spinning unit through the passage 46 into the manifold 44 and through the ports 52 into the passage 18 rearwardly of the forward tapered end 42 of the trumpet, tangentially with respect to the inner surface of the passage 18 forwardly with respect to the axis of the passage 18 and as thus delivered the air sets up a strong vortex which rotates in a clockwise direction with respect to the axis of the passage 18 as it moves forwardly therein. The strong flow of spiraling rotating air under pressure by impact with the roller members in the annular raceway effects rotation of the roller members bodily about an axis coinciding with the axis of the passage 18 in diametrically-disposed relation to each other without constraining rotation of the roller members about their centers. If now roving or its equivalent is advanced by the feed rolls 12—12 into and through the trumpet passage 38 into the passage 18 it will be dispersed by the forwardly-moving vortex of air within the passage 18 so as to produce a gap formed within the passage into an embryonic thread which, in turn, will be advanced into the roller chamber between the rotating roller members which, rotating in the same direction as the vortex, condense and simultaneously twist the embryonic thread so that it emerges from the roller raceway in the form of a spun thread. The rotating ball members tend to condense and polish the thread.

The number of turns per inch that the thread is twisted by the aforesaid spinning unit may be increased or decreased by rotating the ring 78 to align the ports 82 and 76 to a greater or lesser degree of overlap. The greater the air pressure, as it would be if the ports 76 are partially closed, the faster the rotation of the roller members 74. The greater the amount of air pressure escaping, the less pressure there is for effecting rotation of the roller members 74—74.

Figure 4:
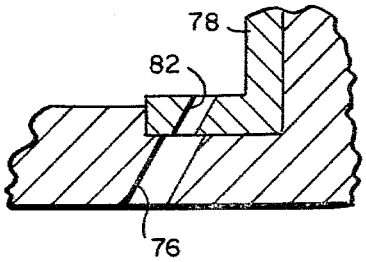
FIG. 4 is a fragmentary section at the forward end of the spinning unit showing the exhaust ports inclined forwardly.
Figure 5:
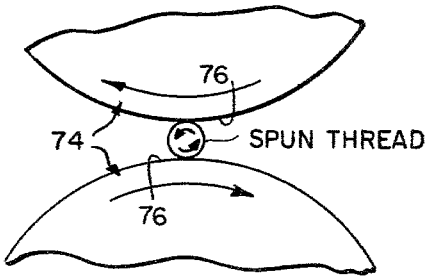
FIG. 5 is an enlarged fragmentary elevation of the roller members with the space between them exaggerated to show the spun yarn and its direction of rotation as it passes between them.

A somewhat modified form of the apparatus is shown in FIG. 4 wherein the ports 76 at the forward end of the part 22 are inclined forwardly. Correspondingly, the ports 82 in the ring 78 are inclined forwardly. The forward inclination in the direction of movement of the air through the passage 18 provides for less turbulent escape of the air in the region of the ports and, hence, less disturbance of the fibers of the thread in its embryonic form within the passage 18.

The roller members 74 desirably have smooth surfaces and may be comprised of metal, wood or plastic, may be hollow or solid and, desirably, should be inert to atmospheric conditions.

As aforesaid, the ports 52 are arranged to impart clockwise rotation within the passage 18. It is within the scope of the invention to produce counterclockwise rotation by the simple expedient of changing the position of the ports. Hence, the spinning unit is capable of making both right and left-hand twist thread.

The spinning unit is mounted so that it can be moved relative to the front rolls, that is, toward the front rolls or away from the front rolls and it is found that the quality of the thread can be changed by such movement. Desirably, the spinning unit should not be more than a staple length away from the front rolls.

It should be understood that the present disclosure is for the purpose of illustration only and includes all modifications or improvements which fall within the scope of the appended claims.

I claim:

1. Apparatus for direct spinning comprising a spinning unit to which staple fibers are supplied and from which a spun thread is withdrawn, said spinning unit defining an elongate, cylindrical chamber of uniform diameter, means for delivering air to the chamber in a forwardly moving vortex, means for delivering staple fibers into a vortex within the chamber, said vortex operating to disperse the fibers as they are delivered into the chamber and reform them into an embryo thread free or false twists, means at the end of the chamber for rotating the embryonic thread as it is withdrawn in the direction of rotation of the vortex to impart a true twist thereto, said means defining an annular raceway at said end of the tubular chamber concentric therewith and means arranged in said annular raceway to be rotated about the axis of the tubular chamber by impingement of the vortex of air moving forwardly through the tubular chamber, said means when rotating within the raceway presenting friction-engendering means turning about the axis of the thread generated within the chamber in the direction of rotation of the vortex.

2. Apparatus for spining comprising a tubular member defining an elongate tubular chamber of uniform diameter, a trumpet at one end of the tubular chamber through which a roving of fibers is led into the chamber, said trumpet defining an elongate passage of smaller diameter than said tubular chamber which is concentric with said chamber, a plurality of ports positioned in the wall of the tubular chamber rearwardly of the inner end of the trumpet, peripherally thereof and in tangential relation to the inner surface of the passage through which air under pressure is supplied to the chamber to create a forwardly moving vortex within the tubular chamber having its origin rearwardly of the inner end of the trumpet passage, means defining an annular raceway at the other end of the tubular chamber concentric therewith the means arranged in said annular raceway to be rotated about the axis of the tubular chamber by impingement of the vortex of air under pressure moving forwardly through the tubular chamber, said means when rotating within the raceway presenting friction engendering means at diametrically opposite sides of the thread path turning about the axis of the thread generated within the chamber in the direction of rotation of the vortex.

3. Apparatus according to claim 2 wherein there is a manifold surrounding the tubular chamber for supplying air under pressure to said ports.

4. Apparatus according to claim 2 wherein the tubular chamber has at its other end rearwardly of the annular raceway peripherally positioned exhaust ports and there is means rotatable relative to the tubular chamber for partially or wholly covering said ports.

5. Apparatus for spinning comprising an elongate tubular member defining a first passage of uniform diameter, a trumpet at one end of the tubular member defining a second passage within the tubular member concentric there-with, a plurality of ports positioned in the wall of the tubular member peripherally of the trumpet and rearwardly of the inner end thereof, said port entering the first passage tangentially and sloping forwardly, means for supplying air under pressure to said ports, a cage mounted to the other end of the tubular member defining an annular raceway concentric with the axis of the first passage, a pair of roller elements mounted in said raceway within the cage of such diameter that their surfaces are substantially tangent to the longitudinal center line of the first passage, and wherein the raceway is of half-circular cross section such that the roller elements are free to rotate bodily within the raceway about the axis of the passage and to rotate about their own centers.

6. Apparatus according to claim 5 wherein there are spaced ports positioned peripherally of the tubular member at its forward end rearwardly of the cage and wherein there is means defining correspondingly-spaced ports mounted to the tubular member peripherally of the portion thereof containing said ports for rotation about the tubular member to at times cover the ports and at other times to partially or completely uncover the ports.

7. Apparatus according to claim 2 including feed rolls for advancing the roving into the trumpet at the one end of the tubular member and feed rolls for removing the thread from the other end of the tubular member.

8. Spinning apparatus comprising in combination a spinning unit and means for continuously delivering a roving to the spinning unit and withdrawing a spun thread therefrom, said spinning unit comprising means defining at first elongate tubular passage of predetermined uniform diameter, means at the entrance to said first elongate tubular passage defining an elongate second tubular passage of smaller diameter positioned centrally thereof with one end extending into the first elongate tubular passage, means at the exit end of the elongate tubular passage defining an annular raceway of larger diameter concentric therewith which is in communication with the forward end of the first elongate tubular passage and which, in turn, defines a circular opening connecting it with the first elongate tubular passage and of substantially corresponding diameter, means for supplying air under pressure to the first elongate tubular passage peripherally of said second longitudinal passage and rearwardly of its inner end, and means rotatable in the annular raceway about the axis of the first elongate tubular passage defining surfaces which are substantially tangent to said axis.

9. Spinning apparatus according to claim 8 wherein the inwardly-extending end of the means containing the elongate second tubular passage is tapered and there are ports positioned in the wall of the first elongate passage about the tapered portion.

10. Spinning apparatus according to claim 9 wherein the ports enter the first passage tangentially to the inner surface thereof.

11. Apparatus according to claim 9 wherein the ports enter the first passage at an angle inclined forwardly.

12. Apparatus according to claim 8 wherein the peripheral edge of the opening from the annular passage is radiused.

13. Apparatus according to claim 8 wherein the last-named means are roller members positioned within the annular chamber.

14. Apparatus according to claim 8 wherein the last-named means are two ball members positioned within the annular chamber.

15. Apparatus according to claim 13 wherein the annular chamber has a toroidal raceway of circular cross section within which the roller members are free to rotate about the axis of the tubular member and about their own centers.

16. Apparatus according to claim 8 wherein the tubular member contains peripherally-positioned ports forwardly of the tapered end of the second passage and rearwardly of the annular chamber.

17. Apparatus according to claim 16 wherein the ports are disposed at right angles to the axis of the first passage.

18. Apparatus according to claim 16 wherein the ports are inclined forwardly relative to the axis of the first passage.

19. A method of spinning comprising subjecting a bundle of fibers to rotation about a predetermined axis while confined within a unidirectional forwardly-moving vortex of air under pressure rotating in the same direction to produce an embryonic thread, continuously supplying fibers to the embryonic thread end in said vortex at a rate with respect to the rate of forward movement of the vortex such as to maintain a gap between the fibers in the roving and the fibers at the thread end which permits the thread end to dissipate false twist and imparting further twist to the embryonic thread between oppositely rotating friction engendering surfaces.

20. Apparatus according to claim 1 comprising means for delivering fibers into the trumpet and means for moving the spinning unit relative to said first-named means.

21. Apparatus according to claim 20 wherein the first-named means are front rolls.

22. Apparatus according to claim 1 comprising front rolls for delivering the fibers into the trumpet and means for optionally moving the spinning unit toward and away from the front rolls.

* * * * *